US010435899B2

(12) United States Patent
Kadlecova et al.

(10) Patent No.: US 10,435,899 B2
(45) Date of Patent: Oct. 8, 2019

(54) DEVICE FOR MANUAL HANDLING OF A THERMO-INSULATING COVER OF A SPA, PARTICULARLY A SWIM SPA

(71) Applicant: USSPA, s.r.o., Dolni Dobrouc (CZ)

(72) Inventors: Katerina Kadlecova, Dolni Dobrouc (CZ); Jan Kadlec, Dolni Dobrouc (CZ)

(73) Assignee: USSPA, s.r.o., Dolni Dobrouc (CZ)

( * ) Notice: Subject to any disclaimer, the term of this patent is extended or adjusted under 35 U.S.C. 154(b) by 0 days.

(21) Appl. No.: 15/856,243

(22) Filed: Dec. 28, 2017

(65) Prior Publication Data

US 2019/0136556 A1 May 9, 2019

(30) Foreign Application Priority Data

Nov. 6, 2017 (CS) ..... 2017-713

(51) Int. Cl.
*E04H 4/08* (2006.01)

(52) U.S. Cl.
CPC ..... *E04H 4/084* (2013.01); *E04H 4/082* (2013.01)

(58) Field of Classification Search
USPC ..... 4/498
See application file for complete search history.

(56) References Cited

U.S. PATENT DOCUMENTS 5,819,332 A * 10/1998 Perry ..... E04H 4/084 4/498
2011/0048654 A1* 3/2011 Kolar ..... E04H 4/084 160/188

FOREIGN PATENT DOCUMENTS

CZ 305124 B6 5/2015

* cited by examiner

*Primary Examiner* — Christine J Skubinna
(74) *Attorney, Agent, or Firm* — Dority & Manning, P.A.

(57) ABSTRACT

A spa includes a thermo-insulating cover having a carrier segment and a carried segment rotatably connected to each other along an axis or rotation, the carrier segment rotatably mounted along an axis of rotation on and above a plane of an edge of the spa. An accumulation member has a fixed portion mounted on the spa and a movable portion that transmits force to the carrier segment. A travelling wheel is mounted on each opposite side at a front end of the carried segment, the wheels having a circumference equal to a distance of the front end of the carried segment spaced from the edge of the spa in the open position of the cover.

5 Claims, 5 Drawing Sheets

DEVICE FOR MANUAL HANDLING OF A THERMO-INSULATING COVER OF A SPA, PARTICULARLY A SWIM SPA

TECHNICAL FIELD

The invention relates to a device for manual handling of a thermo-insulating cover of a spa, especially a swim spa, between its closed position and open position, and vice versa. The thermo-insulating cover includes a pair of thermo-insulating segments consisting of a carrier thermo-insulating segment and a carried thermo-insulating segment, whereby the two segments are rotatably connected to each other and in the closed position are lying by their bottom surfaces on the circumference of the spa. The carrier thermo-insulating cover is rotatably mounted on the spa and is coupled on both sides to control means that facilitate the operator's ability to open and close the cover. The control means include an accumulation member, whose fixed part is mounted on the spa and whose movable part is connected to a system of levers by means of which the force from the accumulation member is transmitted to the carrier segment, which assists the operator in lifting the cover. The two thermo-insulating segments of the spa are provided with manipulating handles and a travelling wheel is mounted on each side at the front end of the carried segment.

BACKGROUND

Nowadays, there are numerous types of spas, also known as whirlpools and swimming pools or swim spas. The latter are spas of larger dimensions which are suitable especially for active swimming. Spas are used for relaxation and rehabilitation and they are also designed to complement houses and villas, both in the interior and the exterior. Spas range in ground plan size from approximately 1×2 m for a spa up to 3×6 m for a swim spa. The structure of a spa is designed to retain heat and keep the water clean for a long time. This is achieved by an insulated structure of a casing and a thermo-insulating cover, which prevents leakage of moisture and heat from the spa, thereby reducing the operation costs. Moreover, the cover prevents injuries of young children and pets, protects the spa from contamination with impurities and dust and prevents penetration of solar radiation, which causes microorganisms to multiply in the water. Even though thermo-insulating covers are made from a lightweight material, their weight is still relatively high due to their dimensions, especially in the case of swim spas, and this makes these covers difficult to handle. The most commonly used thermo-insulating covers consist of two thermo-insulating segments, which are rotatably connected to each other and are manually moved from a closed position to an open position and vice versa. In the closed position, at the beginning of the manual handling, one thermo-insulating segment is facing the other one, so that they are touching each other by their originally upper sides and subsequently they are removed, whereby the cover requires two people, to move it on and off the spa. Another disadvantage of the manual removal of the thermo-insulating cover is the problem with storing the thermo-insulating cover when the spa is used.

Therefore, devices for manual handling of the segments of thermo-insulating covers between their closed position and open position have been developed, including manually controlled mechanical devices and semi-automatic devices, as well as automatic devices reacting only to commands from the operator.

CZ 305124 discloses a device for manual handling of a thermo-insulating cover of a massage or a swim spa between its closed position and open position and vice versa, whereby the thermo-insulating cover comprises a pair of thermo-insulating segments formed by a carrier thermo-insulating segment and a carried thermo-insulating segment. The two segments are rotatably connected to each other and in the closed position are lying by their bottom surfaces on the circumference of the spa, whereby the carrier thermo-insulating cover is rotatably mounted on the spa. The device is arranged on both sides of the cover and comprises means for decreasing the angle between the bottom surfaces of the thermo-insulating segments from 180° to 0° during opening the thermo-insulating cover, and for increasing this angle from 0° to 180° during closing the thermo-insulating cover, whereby these means comprise a gas pressure spring, whose cylinder is fixedly mounted on the massage pool and a piston rod is rotatably connected to to a strut, which is connected to the turning point of a lifting arm, whose other end is by means of a pin rotatably mounted on the carrier thermo-insulating segment. A guiding member is rotatably mounted on the massage pool, the guiding member being slidably mounted in a bushing, which is rotatably mounted on a side wall of the carrier thermo-insulating segment.

Once the carrier thermo-insulating segment reaches the open position in which it is slightly tilted backwards, the operator pushes the carried thermo-insulating segment to the bottom surface of the carrier thermo-insulating segment, whereby the free side of the carried thermo-insulating segment is at this stage, including the travelling wheel, above the level of the edge of the spa, but the facing surfaces of the segments are not touching each other. Due to the backward tilt of the carrier segment, the operator must exert considerable force in the initial closing phase, and therefore large covers of swim spas, where the length of the segments is more than 5 m, must be operated from both sides.

Another problem is the strength of the mounting of the carrier thermo-insulating segment in cases when it is intended to control the swim spa cover, whose length is from 5 to 6 m, the insulation boards having a corresponding weight. Since the two segments of the cover are carried by the carrier segment, only two points on the side of the carrier segment serve to transmit forces from the device for manual handling—a pin on which the carrier arm and the bushing of the guiding member are mounted. Consequently, the carrier segment is overloaded at these points, which causes fatigue damage.

The above-mentioned forces are also transmitted to the edge of the spa and, as a result, its deformations occur.

The aim of the invention is therefore to improve the above-mentioned solution and eliminate its disadvantages.

SUMMARY OF THE INVENTION

Objects and advantages of the invention will be set forth in part in the following description, or may be obvious from the description, or may be learned through practice of the invention.

The goals of the invention are achieved by a device according to the invention, whose principle consists in that a carrier segment is rotatably mounted on the spa about an axis of rotation which is arranged above the plane of the edge of the spa, whereby the greatest distance of the circumference of the travelling wheel from the front end of the carried segment is equal to the distance of the front of the carried segment from the edge of the spa in the open position, whereby from the moment when the circumference of the travelling wheel abuts the edge of the spa during opening, the circumference of the travelling wheel is in contact with the edge of the spa until the open position is reached, in which both segments abut each other and are perpendicular to the plane of the circumference of the spa. During the closing phase, the circumference of the travelling wheel is in contact with the edge of the spa until it is disengaged from this surface at the final stage before the cover is fully closed.

For proper operation, correct attachment of the device for manual handling of the cover is also essential. Due to the size and hence the weight of the cover, it is necessary to ensure that the whole device is fixed sufficiently firmly and the fixation points are efficiently deployed. Among other things, the device must be able to transmit large forces, especially when lifted from the closed position. In addition, it must be able to keep the cover in the open position so that it cannot be released spontaneously. The attachment must therefore be sufficiently dimensioned in weight and position. (attachment can most often be fixed to the shell structure, the casing structure, the surrounding subsoil, which is sufficiently solid).

BRIEF DESCRIPTION OF DRAWINGS

An exemplary embodiment of the invention is schematically represented in the drawings, wherein.

DETAILED DESCRIPTION

Figure 1:
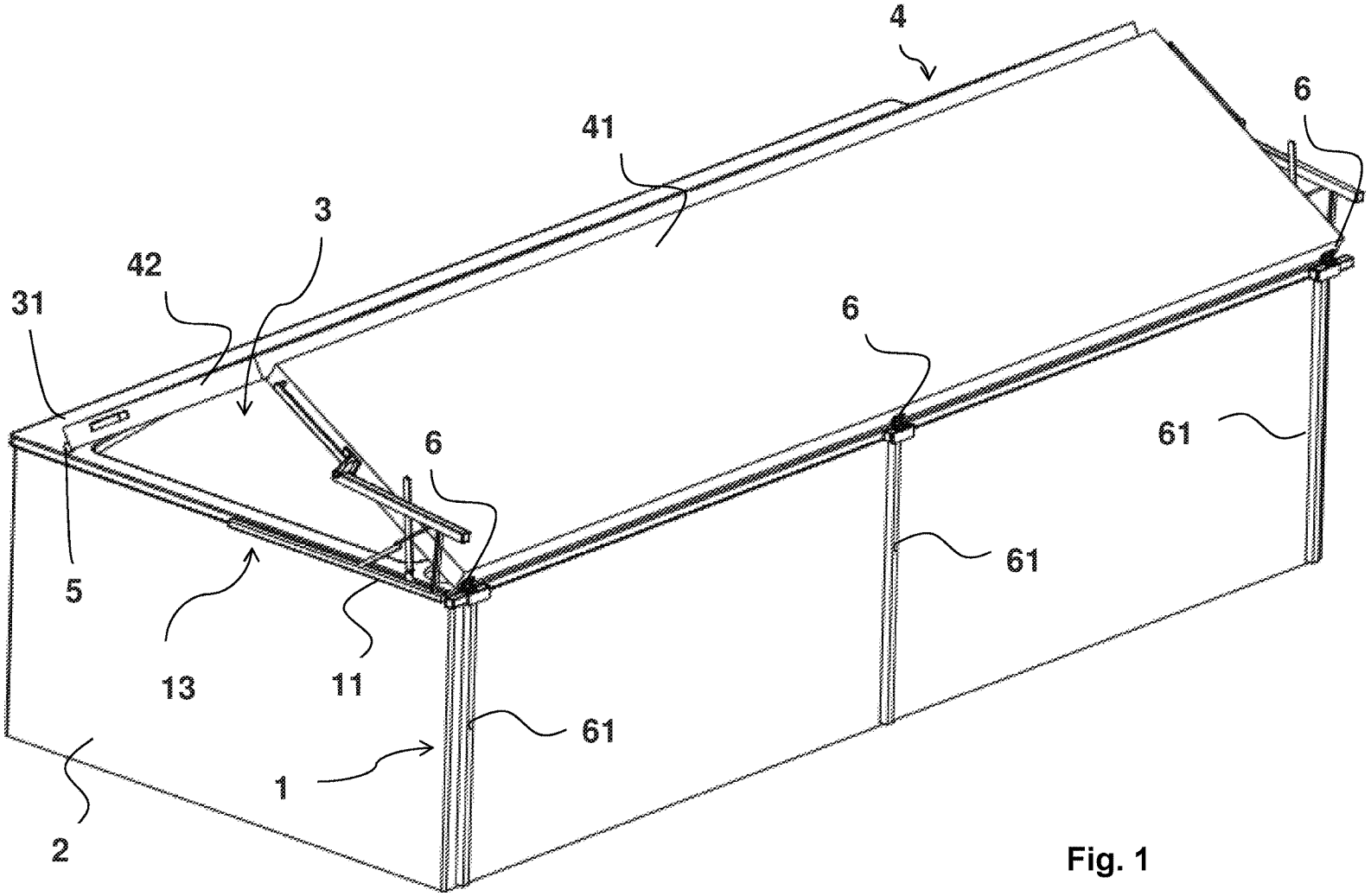
FIG. 1 shows an overall view of a swim spa with a cover and control means in a partially open position.
Figure 2:
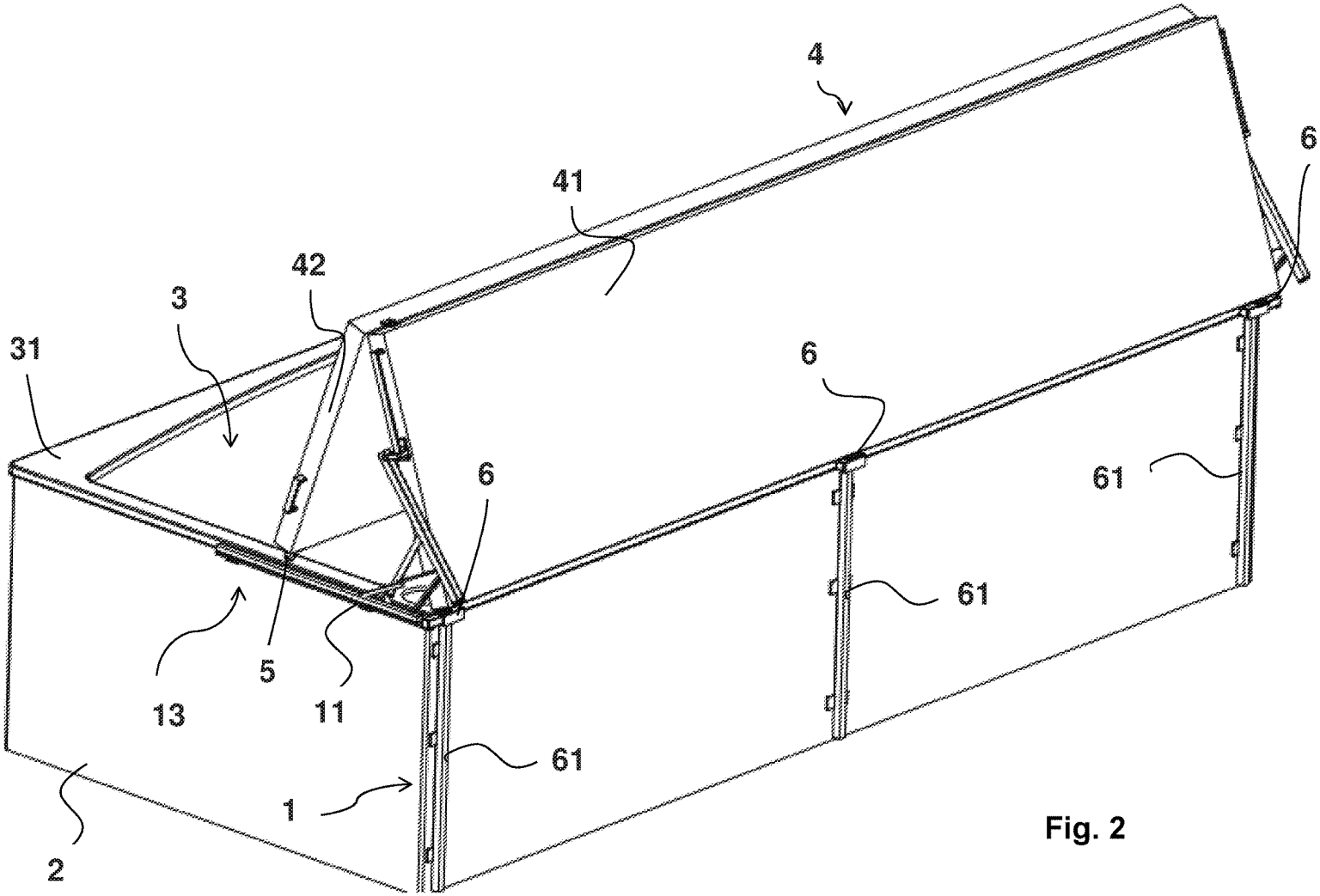
FIG. 2 shows an overall view of the swim spa with the cover and the control means in a position open to about two thirds.
Figure 3:
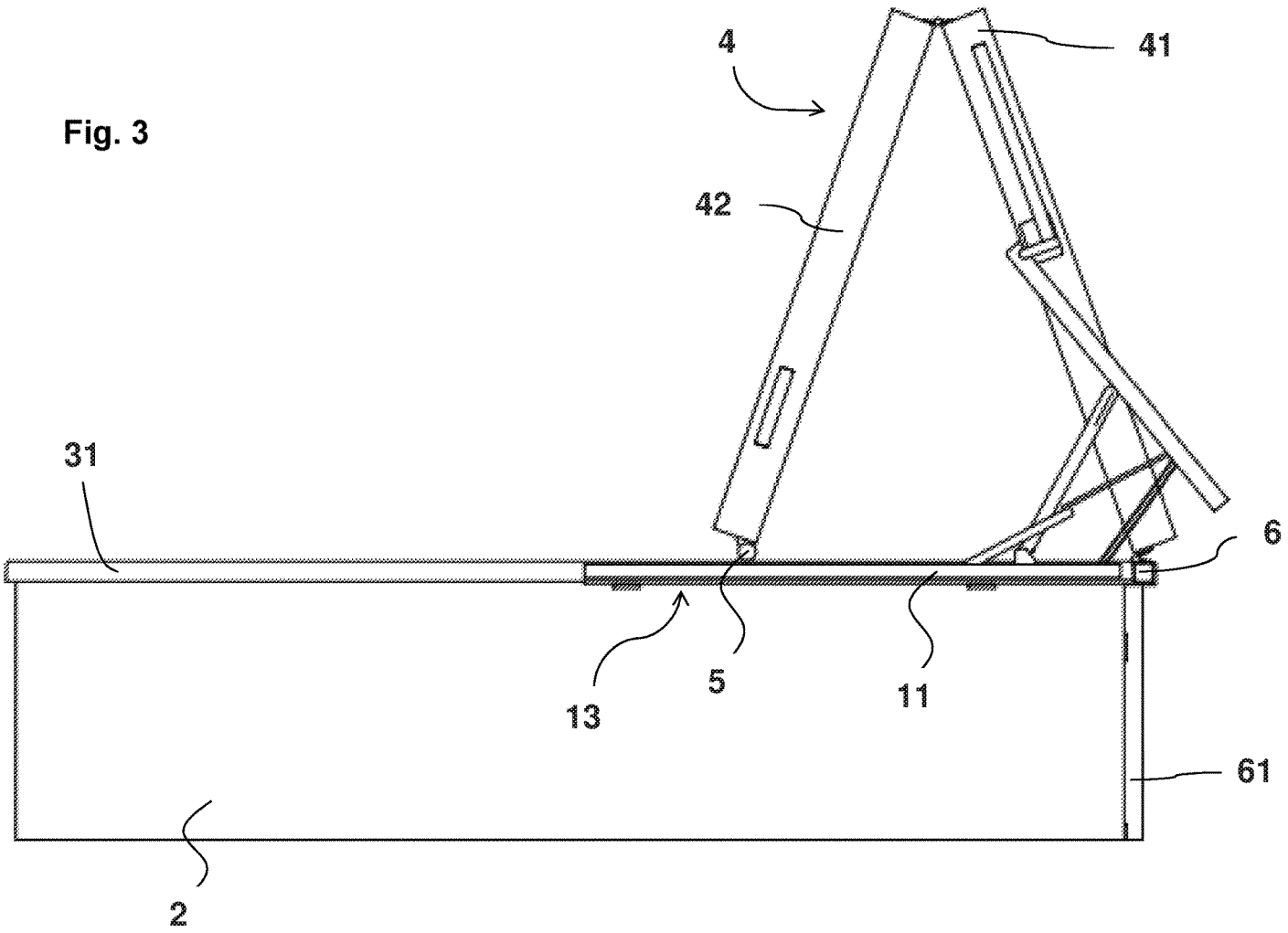
FIG. 3 shows a side view of the swim spa with the cover in the position shown in FIG. 2.
Figure 4:
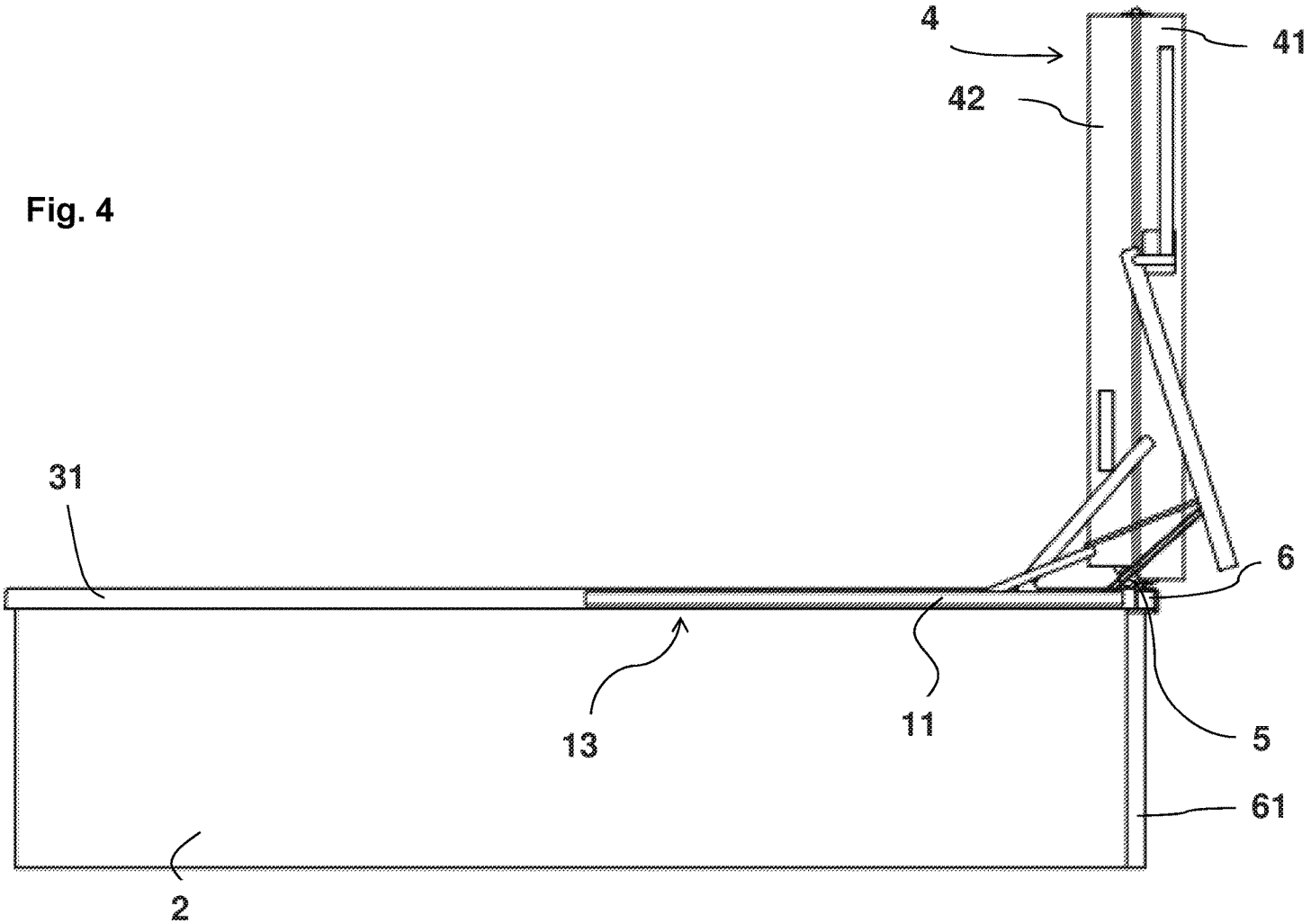
FIG. 4 shows a side view of the swim spa with the cover in the open position.
Figure 5:
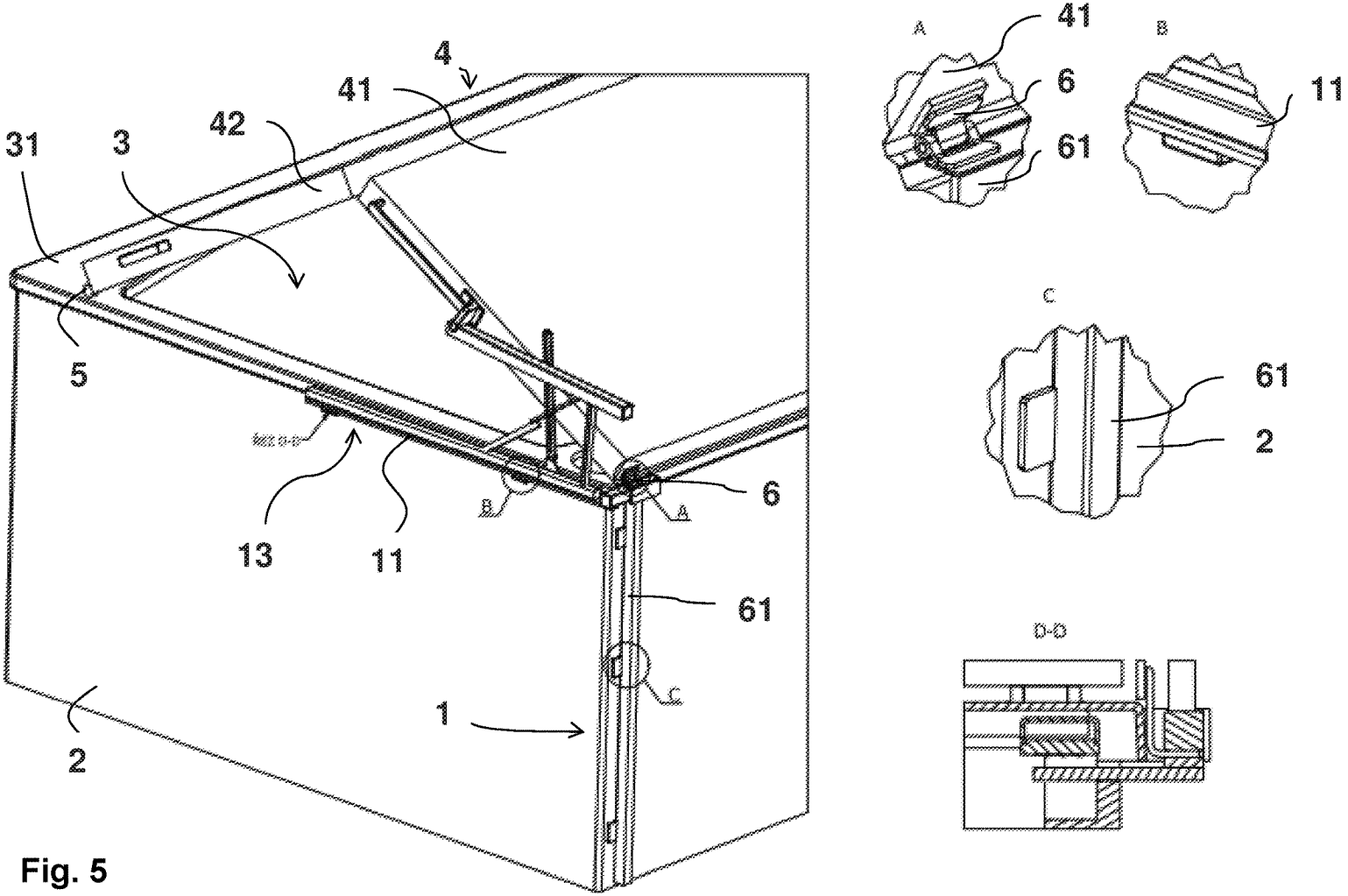
FIG. 5 shows a view of the control means on one side of the spa with a detail (A) of a hinge mounting, a detail (B) of a strut of the fixed portion of the accumulation member, a detail (C) of a supporting strut for mounting the hinge of the carrier segment and a cross-sectional view (D-D) of the mounting of the fixed portion of the accumulation member.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

A swim spa comprises a support structure 1 provided with a casing 2, which protects the spa components, such as water distribution system for water jets, filtering devices and the like. Inside the casing 2, a suitably shaped vessel of the spa is mounted in the support structure, formed by a shell 3, which is in its upper part provided with an edge 31, arranged on a horizontal plane. On the edge 31 of the shell 3 of the spa is mounted a thermo-insulating cover 4, which comprises two thermo-insulating segments 41, 42, abutting the edge 31 of the spa vessel by their bottom surfaces along the entire circumference. Both thermo-insulating segments 41, 42 comprise boards of a thermo-insulating material and are rotatably connected to each other along an axis in the middle section of the thermo-insulating cover 4. One of the thermo-insulating segments 41 is a carrier segment and is rotatably mounted on the supporting structure 1 of the spa along a side edge, and on both sides is coupled to control means, which facilitate the operator's ability to open and close it. The second thermo-insulating segment 42 is carried as a result of being rotatably mounted to the carrier thermo-insulating segment 41 and the rotary motion of the thermo-insulating segment 41 during opening and closing. Mounted at the free front end of the carried segment 42 is a travelling wheel 5 intended to come into contact with the edge 31 of the spa.

The carrier segment 41 of the swim spa is disposed longitudinally on at least three hinges 6, which are mounted on stiffeners 61 in the spa structure 1, whereby the second parts of the hinges 6 are mounted on unillustrated stiffeners of the carrier segment 41. The above-mentioned hinges 6 have a common axis of rotation, which is the axis of rotation of the carrier segment 41 and is arranged above the level of the edge 31 of the spa shell 3.

The carrier segment 41 is coupled on both sides to the control means, which facilitate the operator's ability to open and close the cover 4 and decrease the force necessary for opening and closing the cover 4. The control means comprise an accumulation member 13, which has a fixed portion, in which is mounted a movable portion. In the illustrated embodiment, the accumulation member 13 is composed of a gas pressure spring, whose cylinder constitutes the fixed portion of the accumulation member 13 and is disposed in a fixed manner in a bar 11 which is fixedly mounted or connected to the supporting structure 1 of the spa. The supporting structure 1 is connected to the structure of the shell 3 and in a preferred embodiment, the supporting structure 1 is a part of the shell 3 structure, and so both fixed portions of the accumulation members 13 and the hinges 6 are mounted on the shell structure and form a very firm unit with it. In an exemplary embodiment, the movable part of the accumulation member 13 is composed of a piston and a piston rod, whose free end is connected to a system of levers by means of which the force from the accumulation member 13 is transmitted to the carrier segment 41 and assists the operator in lifting the carrier segment, whereby the force of the accumulation member 13 must be set such as to assist as much as possible the operator in the manual lifting of the carrier segment 41 with the carried member 42 and at the same time such as not to hamper the manual closing of the cover 4, during which new energy is accumulated in the accumulation member 13 for opening the cover 4.

The travelling wheel 5 mounted at the front end of the carried segment 42, which during the opening and closing of the cover 4 travels along the edge 31 and is intended to transmit part of the weight of the cover 4 over the edge 31 of the spa to the supporting structure 1 or directly to of the shell 3 structure. Due to the weight of both segments 41, 42 of the cover 4, it is advisable to provide the edge 31 of the spa shell 3 below the track of the travelling wheels 5 with longitudinal stiffeners, which are in the described embodiment connected to the structure of the shell 3 or the supporting structure 1 of the spa, to prevent their deformation and to prevent the travelling wheels 5 from deviating during the opening or closing of the cover 4.

In order to optimize the size of the forces that assist the operator in opening the cover 4, and so that the operator will not have to lift the carried segment 42 above the edge 31 of the spa at the final stage of opening the cover 4 and transfer the two segments 41, 42 to a backward position, as described in the background art, the dimensions of the segments 41, 42 are adapted in such a manner that the travelling wheel 5 of the carried segment 42 is from the moment of opening the cover 4, when it abuts the edge 31 of the spa, in contact with this edge 31, including a position when the cover is fully opened, when both segments 41, 42 are perpendicular to the plane of the edge 31 of the spa. In this position, the circumference of the travelling wheels 5 on both sides of the swim spa touches the edge 31 of the spa, which is due to the fact that the carried segment 42 is shorter with respect to the carrier segment 41 by the greatest distance of the circumference of the travelling wheel 5 from the front of the carried segment 42, and therefore also in the open position, the circumference of the travelling wheel 5 is in contact with the edge 31 of the spa. This contributes to easier start of the closing of the spa cover 4, because the operator only grips the manipulating handle of the carried segment 42, pulls it and develops only a small amount of force, sufficient just for one side of the swim spa, to start moving the two segments 41, 42 of the cover 4 into their closed position, in which their bottom surfaces abut the edge 31 of the spa.

The invention is not limited to the embodiments specifically described or illustrated herein, since the modification of the principles of the present invention for a particular design, including possible combinations of individual design features, does not go beyond the limits of the present invention or the scope of mere skill. In the drawings, only a few specific embodiments of the spa and the device for manual handling of the thermo-insulating cover 4 and its components are shown in a simplified manner. The design of the entire device and individual components is variable and adaptable to the specific design of the spa and the thermo-insulating cover 4.

The invention can be used for effortless manual handling of a thermo-insulating cover for transition between its closed position and open position.

The invention claimed is:

1. A spa with a system for manual handling of a thermo-insulating cover between a closed position and an open position, and vice versa, comprising:

a spa;

a thermo-insulating cover comprising a carrier segment and a carried segment, whereby the carrier and carried segments are rotatably connected to each other along an axis of rotation and in the closed position are lying with bottom surfaces thereof on a circumference of the spa;

the carried segment comprising a shorter length than the carrier segment as measured transverse to the axis of rotation;

the carrier segment rotatably mounted along the axis of rotation on an edge of the spa that is arranged above a plane of the edge;

control means coupled to opposite sides of the carrier segment to facilitate an operator in opening and closing the thermo-insulating cover, the control means comprising an accumulation member having a fixed portion mounted on the spa and a movable portion that transmits force from the accumulation member to the carrier segment; and a travelling wheel mounted on each opposite side at a front end of the carried segment, the travelling wheels comprising a size that, in combination with the shorter length of the carried segment, causes the travelling wheels to remain in contact with the edge of spa during an entire opening process of the thermo-insulating cover, including in a fully opened position of the thermos-insulating cover when the carrier segment and carried segments abut each other and are perpendicular to a plane of a circumference of the spa.

2. The spa according to claim 1, further comprising handles configured on one or both of the carrier and carried segments at a location to assist the operator in opening and closing the thermo-insulating cover.

3. The spa according to claim 1, wherein the spa comprises support structure, and further comprising at least three hinges mounted on stiffeners in the support structure along the axis of rotation of the carrier segment relative to the spa edge, and wherein the fixed portions of the accumulation members are mounted on the support structure.

4. The spa according to claim 3, wherein the spa comprises a spa shell, and wherein the hinges and fixed portions of the accumulation members of the carrier segment are mounted in the spa shell.

5. The spa according to claim 4, wherein the spa shell comprises stiffeners along side edges of the spa that reinforce a travelling surface for the travelling wheels along the side edges of the spa.

* * * * *